US005518309A

United States Patent [19]

St-Pierre

[11] Patent Number: 5,518,309

[45] Date of Patent: May 21, 1996

[54] DEVICE FOR CATCHING PIECES OF CLOTHES FALLING BEHIND A WASHING MACHINE OR DRYER

[76] Inventor: Jacinthe St-Pierre, 572, de la Gironde, Pintendre, Québec, Canada, 66C-1K7

[21] Appl. No.: 109,440

[22] Filed: Aug. 20, 1993

[30] Foreign Application Priority Data

Aug. 24, 1992 [CA] Canada ..... 2076702

[51] Int. Cl.[6] ..... A47B 96/8; A47F 9/00

[52] U.S. Cl. ..... 312/140.4; 312/228; 312/248; 211/86; 297/182

[58] Field of Search ..... 312/140.4, 228, 312/228.1, 248; 297/182

[56] References Cited

U.S. PATENT DOCUMENTS

| | | | |
|---|---|---|---|
| 99,916 | 2/1870 | Krichbaum . | |
| D. 195,639 | 7/1963 | Ware . | |
| 440,660 | 11/1890 | Smith . | |
| 444,737 | 1/1891 | Turnbull . | |
| 1,192,246 | 7/1916 | Ulrich . | |
| 1,397,670 | 11/1921 | York | 312/248 |
| 2,829,377 | 6/1955 | Anderson . | |
| 2,951,531 | 9/1960 | Dantes | 297/182 |
| 3,173,730 | 3/1965 | Collins | 312/228 |
| 3,245,716 | 4/1966 | Danner | 297/182 |
| 3,697,127 | 10/1977 | Robertson | 297/182 |
| 4,136,907 | 1/1979 | Hermanns | 297/182 |
| 4,659,143 | 4/1987 | MacLennan | 297/182 |
| 4,713,949 | 12/1987 | Wilcox . | |
| 4,940,232 | 7/1990 | Chen . | |

FOREIGN PATENT DOCUMENTS 538402 6/1955 Belgium .

*Primary Examiner*—Peter M. Cuomo
*Assistant Examiner*—Rodney B. White

[57] ABSTRACT

The device catches pieces of clothes susceptible to fall behind a domestic appliance, such as a washing machine and a dryer. The domestic appliance comprises an upper backguard and a rear face spaced apart from a wall standing behind the appliance. A basket-like clothes catching member is mounted behind the backguard substantially over the spacing between the rear face of the domestic appliance and the wall behind this appliance, whereby pieces of clothes susceptible to fall behind the appliance are caught by this basket-like member. The latter member is advantageously pivotally mounted on the backguard so that it can be pivoted to help to recover the caught pieces of clothes.

10 Claims, 1 Drawing Sheet

DEVICE FOR CATCHING PIECES OF CLOTHES FALLING BEHIND A WASHING MACHINE OR DRYER

BACKGROUND OF THE INVENTION

1. Field of the Invention

The present invention relates to a device for catching objects susceptible to fall behind a domestic appliance. More specifically, the present invention is concerned with a device for catching pieces of clothes susceptible to fall behind a domestic appliance, such as a washing machine and a dryer.

2. Brief Description of the Prior Art

When domestic washing machine and dryer are used, dry and/or wet laundry is often temporarily placed on the top surfaces of these washing machine and dryer. Upon handling this laundry, the operator can unintentionally push pieces of clothes behind these washing machine and dryer. Unattended children can also cause falling of laundry behind the washing machine and dryer. These pieces of clothes reach the floor through the space between the rear face of the washing machine and/or dryer and the wall standing behind these washing machine and dryer.

The area behind the domestic washing machine and dryer is usually difficult of access. In order to recover the fallen pieces of clothes, the domestic appliances must, in most of the cases, be displaced. This is time-consuming and requires physical strength. Displacement of theses heavy domestic appliances can even causes damages, for example to the floor on which they are slid.

OBJECT OF THE INVENTION

An object of the present invention is therefore to solve the above discussed problem by providing a device capable of catching pieces of clothes susceptible to fall behind a domestic appliance, such as washing machines and dryers.

SUMMARY OF THE INVENTION

In accordance with the present invention, there is provided a device for catching objects susceptible to fall behind a domestic appliance having an upper portion and a rear face facing and spaced apart from a wall standing behind this appliance. The device comprises object catching means, and means for mounting the object catching means behind the upper appliance portion substantially over the spacing between the rear face of the domestic appliance and the wall standing behind this appliance, whereby objects susceptible to fall behind the appliance are caught by the object catching means.

Also in accordance with the present invention, there is provided a device for catching pieces of clothes susceptible to fall behind a domestic appliance, such as a washing machine and a dryer. The domestic appliance has an upper portion and a rear face facing and spaced apart from a wall standing behind the appliance. The device of the invention comprises first means for catching pieces of clothes, and second means for mounting the first means behind the upper appliance portion substantially over the spacing between the rear face of the domestic appliance and the wall standing behind this appliance, whereby pieces of clothes susceptible to fall behind the domestic appliance are caught by the first means.

According to preferred embodiments of the present invention, (a) the first means is pivotally mounted on the upper appliance portion whereby it can be pivoted to help to recover the caught pieces of clothes, (b) the first means comprises basket means, (c) the basket means comprises netting, and (d) the netting is flexible.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENTS

Although the preferred embodiments of the present invention will be described in the following description with reference to pieces of clothes, a washing machine, and a dryer, it will readily appear to those skilled in the art that the concept of the invention can also be used to catch other objects susceptible to fall behind other types of appliances, domestic or not.

First Embodiment

Figure 1:
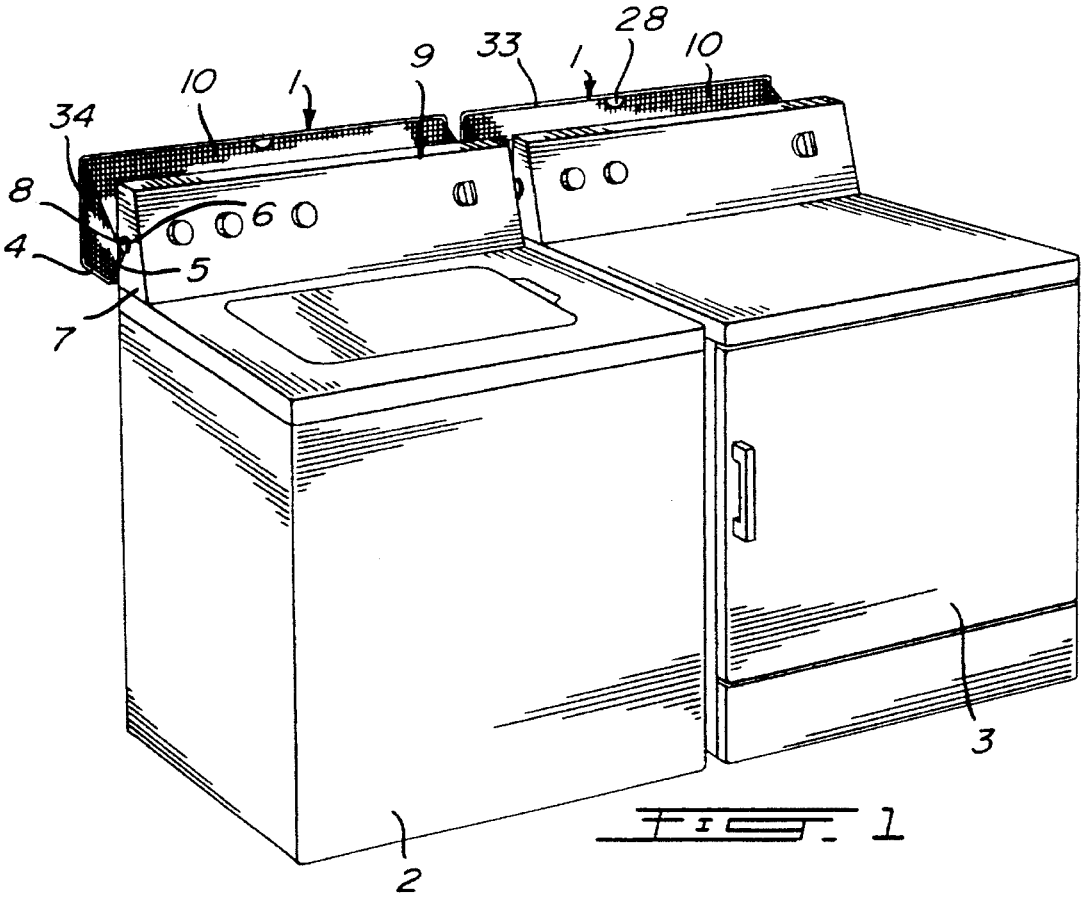
FIG. 1 is a perspective view of a conventional washing machine and dryer combination provided with devices in accordance with the present invention for catching pieces of clothes susceptible to fall behind these washing machine and dryer.

In FIG. 1, a device 1 in accordance with the present invention is installed behind both a washing machine 2 and a dryer 3 placed side by side to form a washing machine and dryer combination.

As illustrated in FIG. 1, the length of the device 1 corresponds substantially to the width of the domestic appliance 2 or 3.

Figure 2:
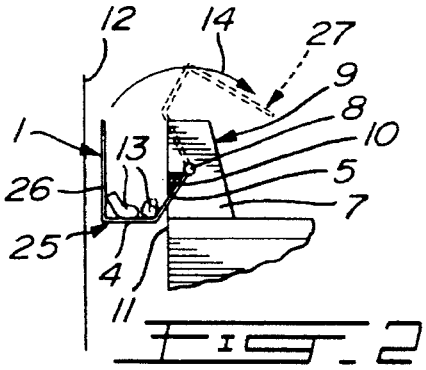
FIG. 2 is a side elevational view of the catching devices of FIG. 1.

In cross-section, the device 1 is generally U-shaped (FIG. 2). At both ends, the device 1 includes a straight extension 5 oblique with respect to the horizontal and connected to the bottom portion 4 of the device 1. The free end of the extension 5 comprises an eyelet 6 (FIG. 1). As shown in FIGS. 1 and 2, the extension 5 extends parallel and close to a side face 7 of the upper backguard 9 of the domestic appliance 2 or 3. A pivot 8 is fixed, for example screwed, on the side face 7 to receive the eyelet 6 and thereby pivotally attach the corresponding end of the device 1 on the backguard 9. The device 1 is also pivotally mounted on the opposite side face of the backguard 9 of the domestic appliance 2 or 3 through corresponding extension, eyelet and pivot (not shown) identical to extension 5, eyelet 6 and pivot 8. Accordingly, the device 1 is pivotally mounted on the backguard 9 about the two pivots such as 8 respectively screwed on the opposite side faces such as 7.

The generally U-shaped device 1 may comprise netting 10 (FIG. 1) with peripheral support wires including the extensions such as 5. At least the netting between the extensions such as 5 is flexible to embrace the side and rear faces 7 and 11 of the backguard 9 when the device is in position 25 (FIG. 2).

In operation, the device 1 is positioned behind the backguard 9 to substantially cover the spacing between the rear face 11 of the appliance 2 or 3 and the wall 12 standing behind this domestic appliance (position 25). Accordingly, pieces of clothes such as 13 susceptible to fall behind the domestic appliance 2 or 3 between the rear face 11 and the wall 12 are caught by the netting 10 of the U-shaped device 1. This prevents the pieces of clothes 13 to reach the floor behind the appliance 2 or 3 where they are very difficult to reach and therefore to recover. As can be appreciated, the pieces of clothes 13 caught by the device 1 are very easy to recover. Pivoting of the device 1 about the two pivots such as 8 in direction 14 can make such recovery easier.

It should be pointed out here that the vertical portion 26 of the device 1 is slightly spaced apart from the wall 12 to enable pivoting of the device 1 in direction 14 up to position 27 (FIG. 2).

As illustrated for the device 1 of FIG. 1 installed behind the backguard of the dryer 3, the vertical portion 26 (FIG. 2) of the device 1 may be provided with a small hole 28 near its upper horizontal edge 33 (FIG. 1). This hole 28 can be engaged with a finger to facilitate pivoting of the device 1 from position 25 to position 27 (FIG. 2).

FIG. 1 also illustrates, in accordance with a preferred embodiment, a device 1 provided with an end wall 34.

Second Embodiment

Figure 3:
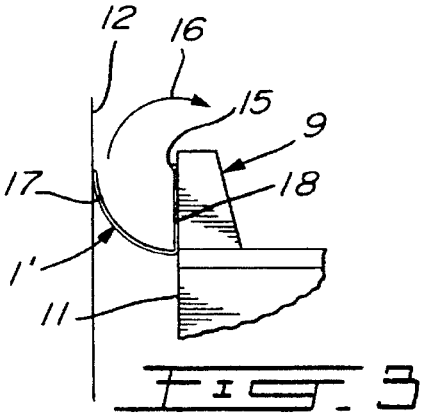
FIG. 3 is a side elevational view of a second embodiment of the device in accordance with the present invention, for catching pieces of clothes susceptible to fall behind a washing machine and/or dryer.

In the embodiment of FIG. 3, the device 1' has a substantially V-shaped cross section. It comprises a vertical front portion 18 made of rigid netting and applied against the rear face 11 of the domestic appliance 2 or 3. The upper longitudinal edge of the vertical portion 18 is pivotally mounted on the rear face 11 of the backguard 9 through a hinge means 15. The arcuate rear portion 17 of the V-shaped device 1', also made of rigid netting, has an upper edge resting on the wall 12. The portion 17 is arcuate to allow the device 1' to pivot in direction 16 about the hinge means 15 to help to recover the caught pieces of clothes.

The embodiment of FIG. 3 presents the advantage of covering totally the spacing between the rear face 11 and the wall 12 while enabling pivoting of the device 1' in direction 16 about the hinge means 15. Accordingly, any pieces of clothes susceptible to fall behind the domestic appliance 2 or 3 is caught by the device 1' and can be easily recovered by pivoting this device in direction 16.

The arcuate rear portion 17 of the device 1' can also be provided with a hole (such as 28 in FIG. 1) that can be engaged with a finger to facilitate pivoting of device 1' in direction 16.

Third Embodiment

Figure 4:
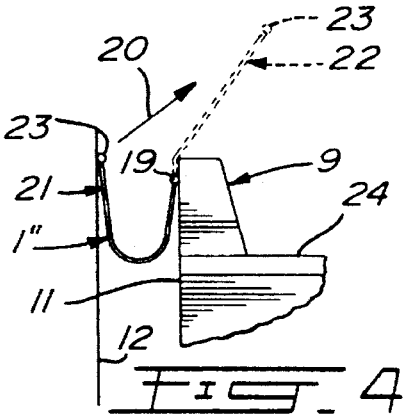
FIG. 4 is a side elevational view of a third embodiment of the device in accordance with the present invention, for catching pieces of clothes susceptible to fall behind a washing machine and/or dryer.

Regarding the embodiment 1" of FIG. 4, it is made of flexible netting. It comprises one longitudinal edge connected to the rear face 11 through a hinge means 19 whereby the device 1" can be pivoted about the rear face 11 of the backguard 9. The flexible netting of the device 1" can be bent and hold in position 21, shown in FIG. 4, with its second longitudinal edge 23 applied to the wall 12, the degree of flexibility of the netting being selected for that purpose. In position 21, the device 1" covers all the spacing between the rear face 11 and the wall 12 whereby any pieces of clothes susceptible to fall behind the appliance are caught by the flexible netting of the device 1".

To recover the pieces of clothes caught by the device 1" in position 21, one has only to pull the edge 23 in direction 20 until the cross section of the device 1" is straight (see 22 in FIG. 4) where the caught pieces of clothes fall on the top surface 24 of the domestic appliance 2 or 3. Again, a hole such as 28 in FIG. 1 can be provided.

Fourth Embodiment

Figure 5:
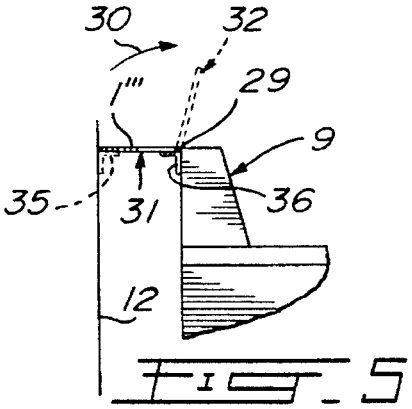
FIG. 5 is a side elevational view of a fourth embodiment of the device in accordance with the present invention, for catching pieces of clothes susceptible to fall behind a washing machine and/or dryer.

In the embodiment of FIG. 5, the device 1''' is flat and generally horizontal. It is made of rigid netting and extends between the rear face 11 of the domestic appliance 2 or 3 and the wall 12. Its proximate, longitudinal edge is pivotally mounted on the rear face 11 of the backguard 9 through a hinge means 29 whereby the clothes catching device 1 can be pivoted in direction 30 from its horizontal position 31 to position 32 in order to recover the caught pieces of clothes. Again, a hole such as 28 in FIG. 1 is provided.

The embodiment of FIG. 5 however requires (a) at least one bracket 35, L-shaped in cross section, and fixed to the wall 12, and/or (b) at least one bracket 36, L-shaped in cross section and fixed to the rear wall 11 of the domestic appliance 2 or 3 to support the device 1 and hold it horizontal.

Those skilled in the art will appreciate that the material of which the clothes catching device in accordance with the present invention is made can widely vary. The present invention is obviously not limited to a specific material.

Although the present invention has been described hereinabove by way of preferred embodiments thereof, these embodiments can be modified at will, within the scope of the appended claims, without departing from the spirit and nature of the present invention.

The embodiments of the invention in which an exclusive property or privilege is claimed are defined as follows:

1. A combination of a generally upright wall and domestic appliance, the combination comprising:

the domestic appliance having an upper portion and a rear face facing and spaced apart from the generally upright wall;

an object catching member for catching objects susceptible fall between the rear face of the domestic appliance and the generally upright wall; and means for mounting said object catching member behind the upper appliance portion whereby said object catching member extends outwardly in a generally horizontal position from the rear face of the domestic appliance to form a receptacle or support surface and extends substantially over a spacing between the rear face of the domestic appliance and the generally upright wall whereby objects falling between the generally upright wall and the rear face of the domestic appliance are caught by said object catching member.

2. The combination of claim 1, in which said mounting means comprises means for attaching said object catching member to the upper appliance portion.

3. The combination of claim 1, in which said mounting means comprises means for pivotally mounting said object catching member on the upper appliance portion, whereby said object catching member can be pivoted about the upper appliance portion in order to help to recover the caught objects.

4. The combination of claim 1, in which said mounting means comprises means for pivotally mounting said object catching member on the rear face of the upper appliance portion, whereby said object catching member can be pivoted about the domestic appliance in order to help to recover the caught objects.

5. The combination of claim 1, wherein, the upper appliance portion comprising two opposite side faces, said mounting means comprises means for pivotally mounting said object catching member on the opposite side faces of the upper appliance portion, whereby said object catching member can be pivoted about the upper appliance portion in order to help to recover the caught objects.

6. A combination of a generally upright wall and a domestic appliance such as a washing machine and a dryer, the combination comprising:

the domestic appliance having an upper portion and a rear face facing and spaced apart from the generally upright wall;

a clothes catching member for catching clothes susceptible to fall between the rear face of the domestic appliance and the generally upright wall; and means for mounting said clothes catching member behind the upper appliance portion whereby said object catching member extends outwardly in a generally horizontal position from the rear face of the domestic appliance to form a receptacle or support surface and extends substantially over a spacing between the rear face of the domestic appliance and the generally upright wall whereby clothes falling between the generally upright wall and the rear face of the domestic appliance are caught by said clothes catching member.

7. A combination as recited in claim 6, wherein said mounting means comprises means for attaching the clothes catching member to the upper appliance portion.

8. A combination as recited in claim 6, wherein said mounting means comprises means for pivotally mounting said clothes catching member on the upper appliance portion, whereby said clothes catching member can be pivoted about the upper appliance portion in order to help to recover the pieces of clothes caught by said clothes catching member.

9. A combination as recited in claim 6, wherein said mounting means comprises means for pivotally mounting said clothes catching member on the rear face of the upper appliance portion, whereby said clothes catching member can be pivoted about the domestic appliance in order to help to recover the pieces of clothes caught by said clothes catching member.

10. A combination as recited in claim 6, wherein, the upper appliance portion comprising two opposite side faces, said mounting means comprises means for pivotally mounting said clothes catching member on the opposite side faces of the upper appliance portion, whereby said clothes catching member can be pivoted about the upper appliance portion in order to help to recover the pieces of clothes caught by said clothes catching member.

* * * * *